US010128060B2

(12) United States Patent
Robinson

(10) Patent No.: US 10,128,060 B2
(45) Date of Patent: Nov. 13, 2018

(54) LIGHT SWITCH COVER

(71) Applicant: Cecila Robinson, Lithonia, GA (US)

(72) Inventor: Cecila Robinson, Lithonia, GA (US)

( * ) Notice: Subject to any disclaimer, the term of this patent is extended or adjusted under 35 U.S.C. 154(b) by 26 days.

(21) Appl. No.: 15/414,022

(22) Filed: Jan. 24, 2017

(65) Prior Publication Data

US 2017/0221650 A1 Aug. 3, 2017

Related U.S. Application Data

(60) Provisional application No. 62/388,455, filed on Feb. 1, 2016.

(51) Int. Cl.
*H01H 9/22* (2006.01)
*H01H 19/04* (2006.01)

(52) U.S. Cl.
CPC ..... *H01H 9/22* (2013.01); *H01H 19/04* (2013.01)

(58) Field of Classification Search
CPC ..... H01H 9/22; H01H 19/04; H01H 9/287; H01H 9/18; H01H 9/182; H01H 23/025; H01H 23/14; H01H 2009/048; H01H 23/04
USPC ..... 200/333, 302.3, 304, 43.16, 43.19
See application file for complete search history.

(56) References Cited

U.S. PATENT DOCUMENTS 3,028,467 A * 4/1962 Hubbell ..... H01H 23/06 174/66
4,102,471 A 7/1978 Lore et al.
4,363,944 A 12/1982 Poirier
4,399,340 A 8/1983 Crandall et al.
4,745,243 A 5/1988 Wang
4,972,045 A * 11/1990 Primeau ..... H01H 15/10 174/66
5,009,610 A 4/1991 Woskow
D351,376 S 10/1994 Hughes
D396,401 S 7/1998 Christie
5,811,730 A 9/1998 Rintz
5,955,702 A 9/1999 Grossman et al.
(Continued)

OTHER PUBLICATIONS

AmerTac CSG1 Westek White Switch Guard Part No. CSG1, retrieved from <http://www.hardwareandtools.com/amertac-csgl-westek-white-switch-guard-ulab-9335.html> on Mar. 3, 2017, 3 pages.

(Continued)

*Primary Examiner* — Edwin A. Leon
(74) *Attorney, Agent, or Firm* — Alston & Bird LLP

(57) ABSTRACT

A light switch cover includes a base portion defining a central opening and including a first base engagement member and a second base engagement member, a cover pivotally coupled to the base portion, a first cover engagement member positioned on the cover, where the first cover engagement member has a complementary shape to the first base engagement member, and where the first cover engagement member is selectively engaged with the first base engagement member when the cover is in the closed position, and a second cover engagement member positioned on the cover, where the second cover engagement member has a complementary shape to the second base engagement member, and where the second cover engagement member is selectively engaged with the second base engagement member when the cover is in the closed position.

20 Claims, 11 Drawing Sheets

(56) References Cited

U.S. PATENT DOCUMENTS

Figure 1:
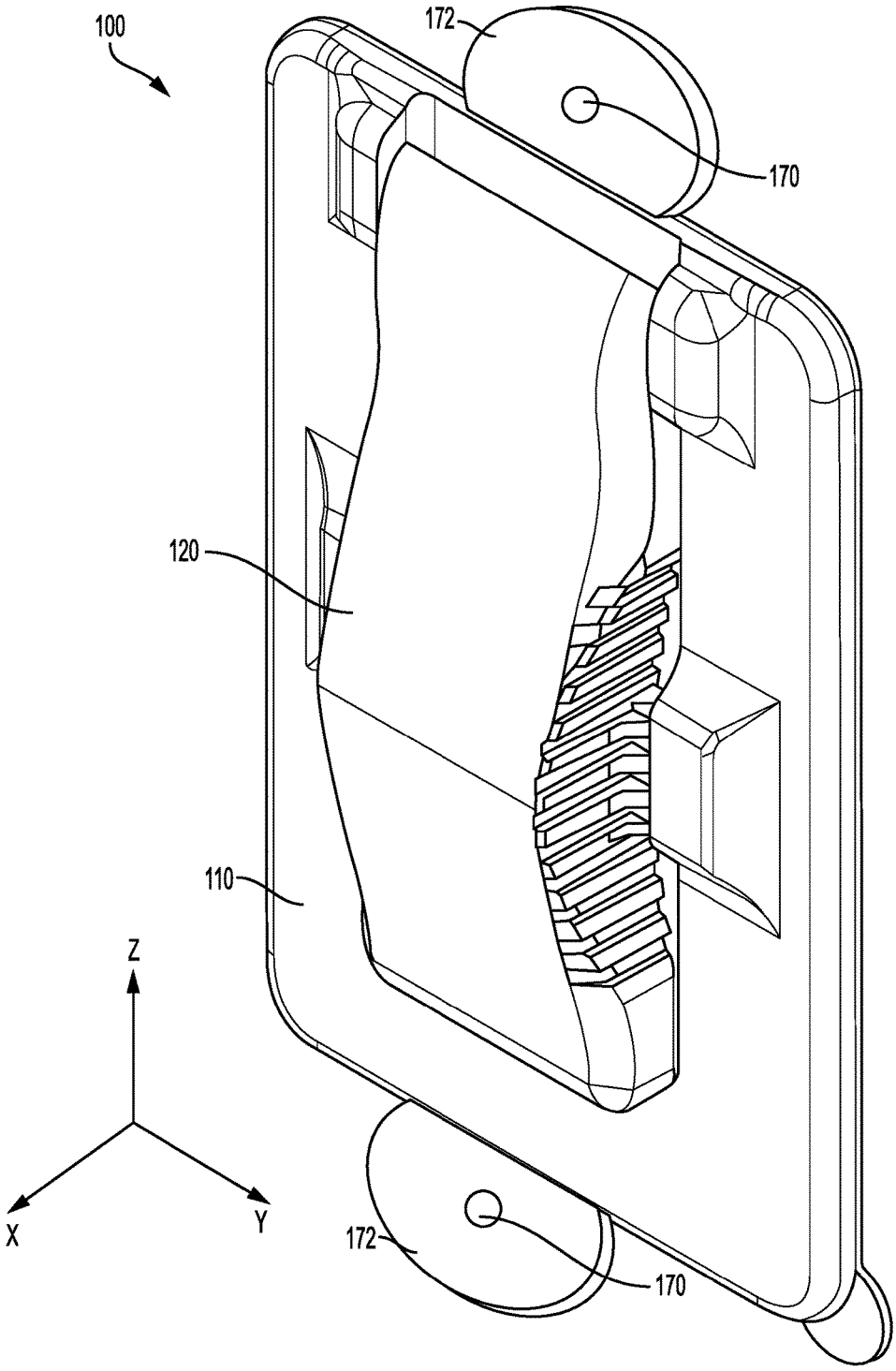

| | | | | |
|---|---|---|---|---|
| D466,870 | S | 12/2002 | Elliott | |
| 6,984,900 | B1 | 1/2006 | Bruwer | |
| D617,173 | S | 6/2010 | Anzalone et al. | |
| 9,496,696 | B2 * | 11/2016 | Bulancea | H02G 3/14 |
| 2003/0155220 | A1 | 8/2003 | Cho | |
| 2005/0133353 | A1 * | 6/2005 | Whitman | H01H 3/20 200/333 |
| 2010/0170773 | A1 | 7/2010 | Grisby | |
| 2016/0111231 | A1 * | 4/2016 | Choi | H01H 13/14 200/344 |

OTHER PUBLICATIONS

Safety 1st™ Switch-Lock Guard Model No. 48361 retrieved from <http://www.realrecreationusa.com/p/Switch-lock-Guard-37002563.html> on Mar. 3, 2017, 3 pages.

Safety Innovations™ Light Switch Guard, Decora retrieved from <http://www.safebeginnings.com/WebComponents/Catalog/Public/showproduct.asp?id=1063&cat=Nursery> on Mar. 3, 2017, 2 page.

Set of 3 Locking Push Botton Light Switch Guards, retrieved from <http://www.qvc.com/Set-of-3-Locking-Push-Button-Light-Switch-Guards.product.V25122.html> on Mar. 3, 2017, 5 pages.

Switch Guard Set of 2, retrieved from <http://www.carolwrightgifts.com/switch-guard-set-of-2/53166.cfm> on Mar. 3, 2017, 3 pages.

* cited by examiner

LIGHT SWITCH COVER

CROSS-REFERENCE TO RELATED APPLICATIONS

This application claims priority to U.S. Provisional Patent Application Ser. No. 62/388,455 entitled "Litez Out—Switch Guard Protector," filed on Feb. 1, 2016, which is hereby incorporated by reference.

BACKGROUND

Interior and exterior illumination for homes and businesses conventionally include light switches that selectively turn lights on and off. These light switches can also be used to selectively turn various electrical devices on and off, such as garbage disposals, furnaces, whirlpools, fans, and other household electronics. In some configurations, light switches can be used to selectively allow or restrict electrical power to a power outlet.

In some circumstances, it is desirable to limit access to light switches to prevent unintentional or unauthorized manipulation of the light switch. For example, with small children or with special needs individuals, it may be desirable to limit access to the light switches to authorized individuals. Conventional light switch covers have been used to restrict access to light switches, however, these conventional light switch covers may not fully restrict access to the light switch. Furthermore, conventional light switch covers may be difficult to install to existing light switches.

Accordingly, a need exists for alternative light switch covers that can be used in conjunction with conventional light switches.

BRIEF SUMMARY

In one embodiment, a light switch cover includes a base portion defining a central opening, the base portion including an outer perimeter that extends around the central opening, a first base engagement member extending outward from the base portion and positioned on a first side of the central opening, a second base engagement member extending outward from the base portion and positioned on a second side of the central opening that is different from the first side of the central opening, a cover pivotally coupled to the base portion, where the cover is repositionable between a closed position, in which the cover is positioned over the central opening, and an open position, in which the central opening is exposed, a first cover engagement member positioned on the cover, where the first cover engagement member has a complementary shape to the first base engagement member, and where the first cover engagement member is selectively engaged with the first base engagement member when the cover is in the closed position, and a second cover engagement member positioned on the cover, where the second cover engagement member has a complementary shape to the second base engagement member, and where the second cover engagement member is selectively engaged with the second base engagement member when the cover is in the closed position.

In another embodiment, a light switch cover includes a base portion defining a central opening, the base portion including an outer perimeter that extends around the central opening, a base engagement member positioned on the base portion, a cover pivotally coupled to the base portion, where the cover is repositionable between a closed position, in which the cover is positioned over the central opening, and an open position, in which the central opening is exposed, a cover engagement member positioned on the cover, where the cover engagement member has a complementary shape to the base engagement member, and where the cover engagement member is selectively engaged with the base engagement member when the cover is in the closed position, and where the cover defines a gripping surface that is operatively connected to the cover engagement member, where the gripping surface is repositionable between an extended position, in which the cover engagement member is in an extended position, and a retracted position, in which the cover engagement member is in a retracted position.

BRIEF DESCRIPTION OF THE SEVERAL VIEWS OF THE DRAWING(S)

Figure 2:
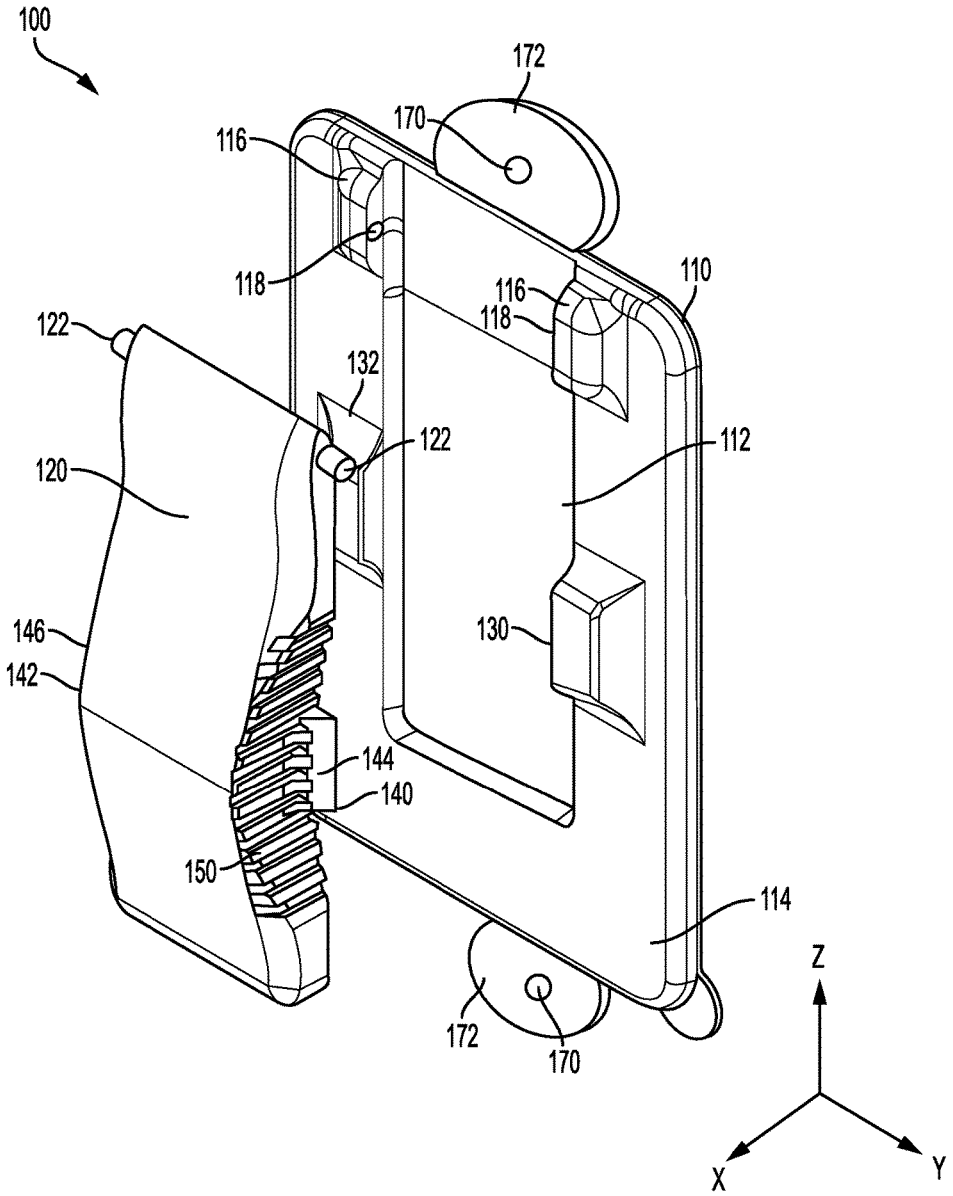
Figure 3:
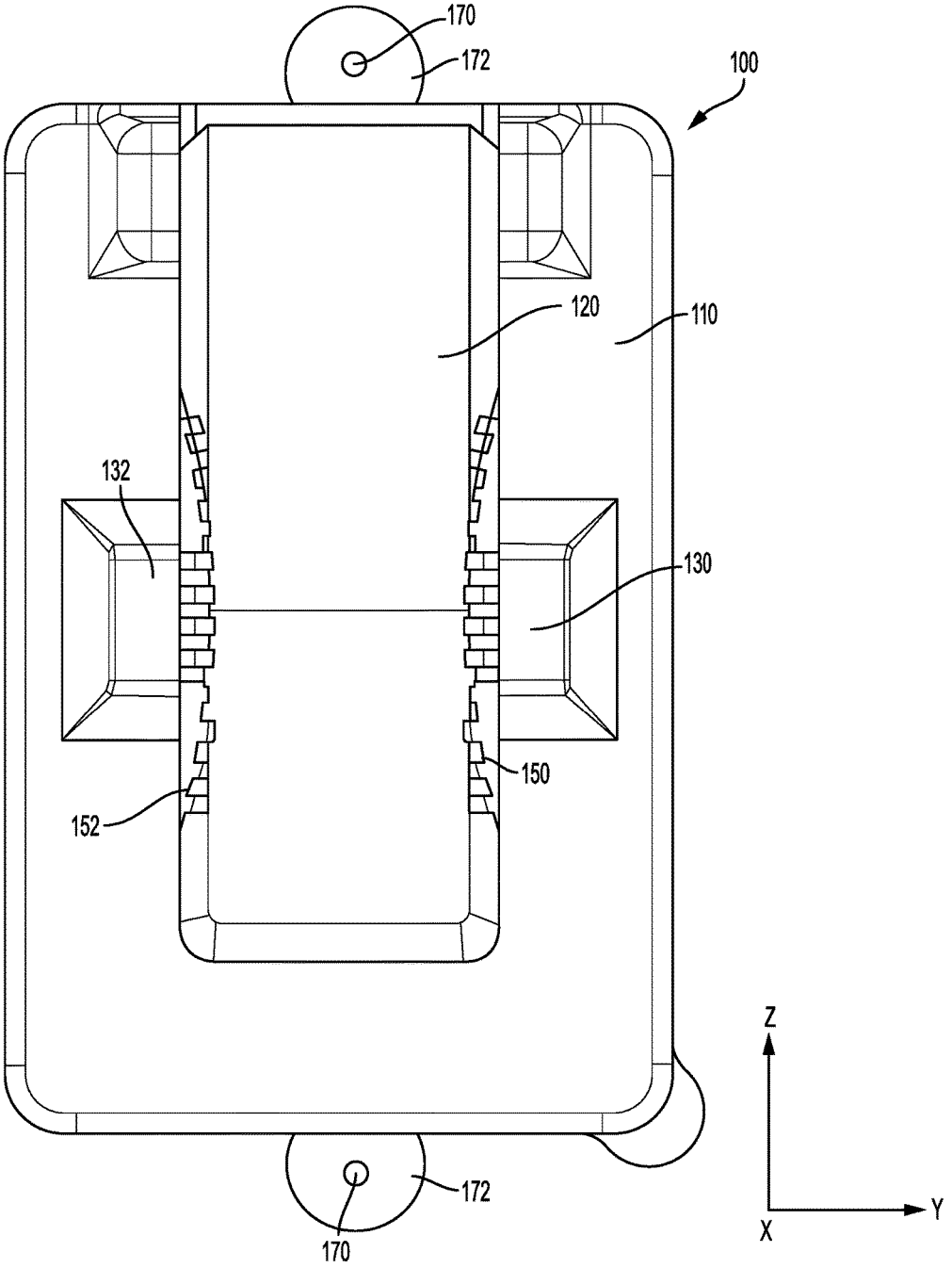
Figure 4:
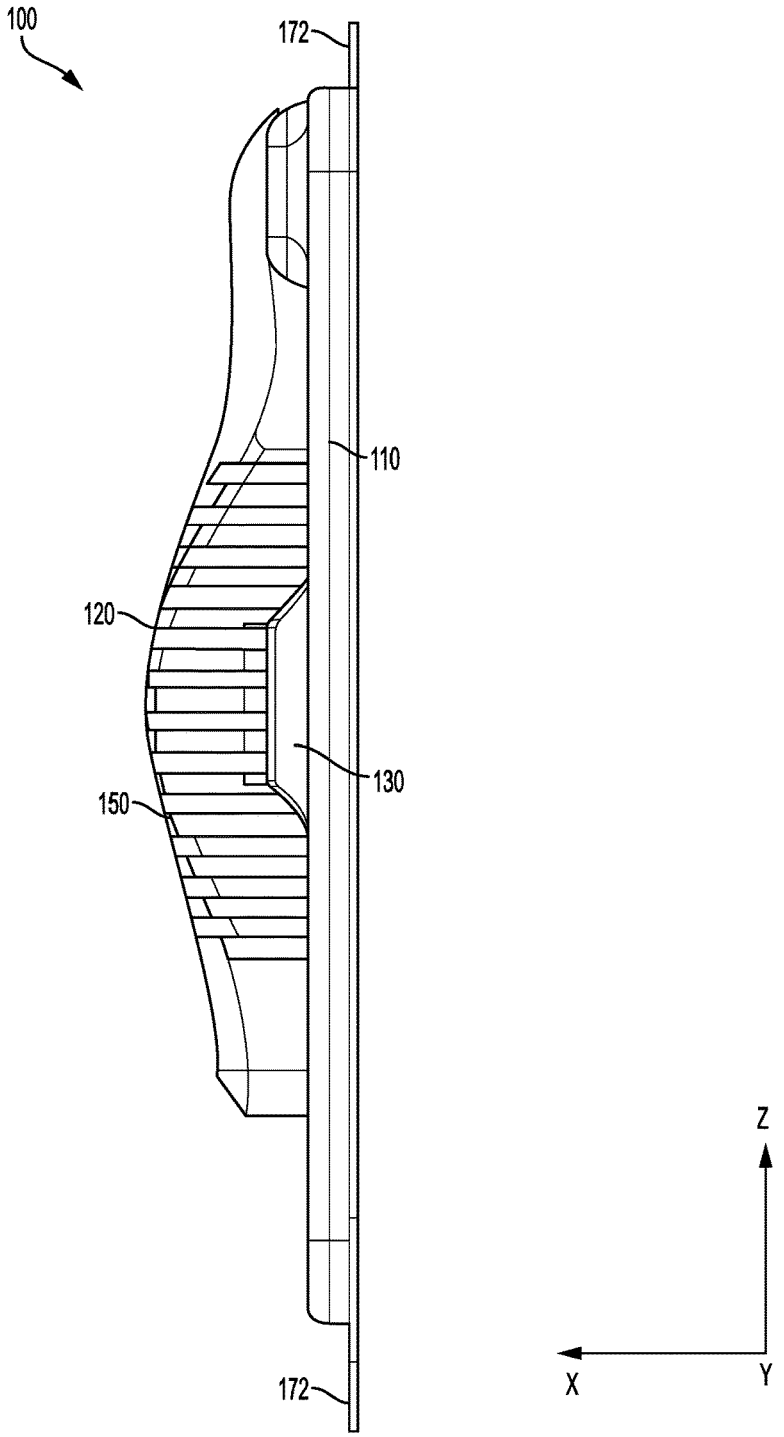
Figure 5:
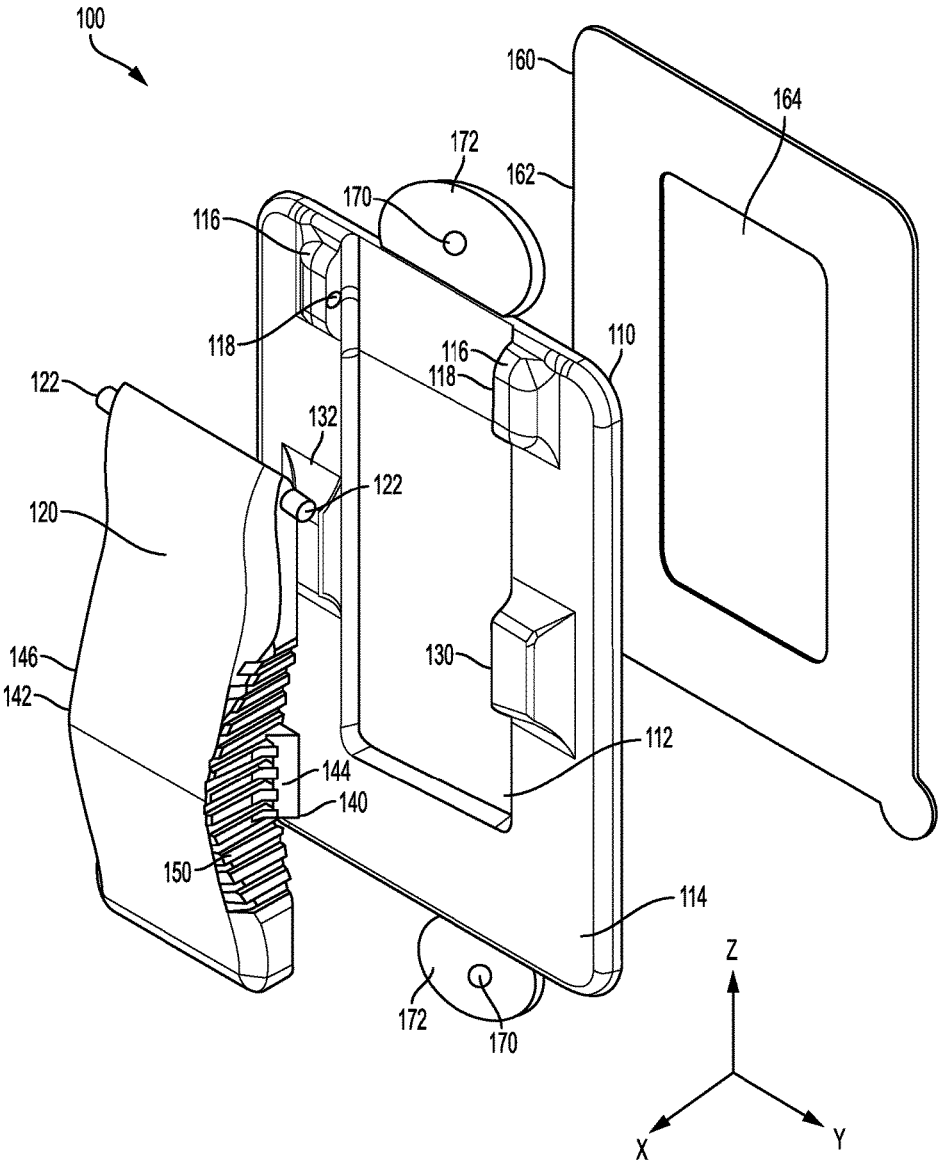
Figure 6:
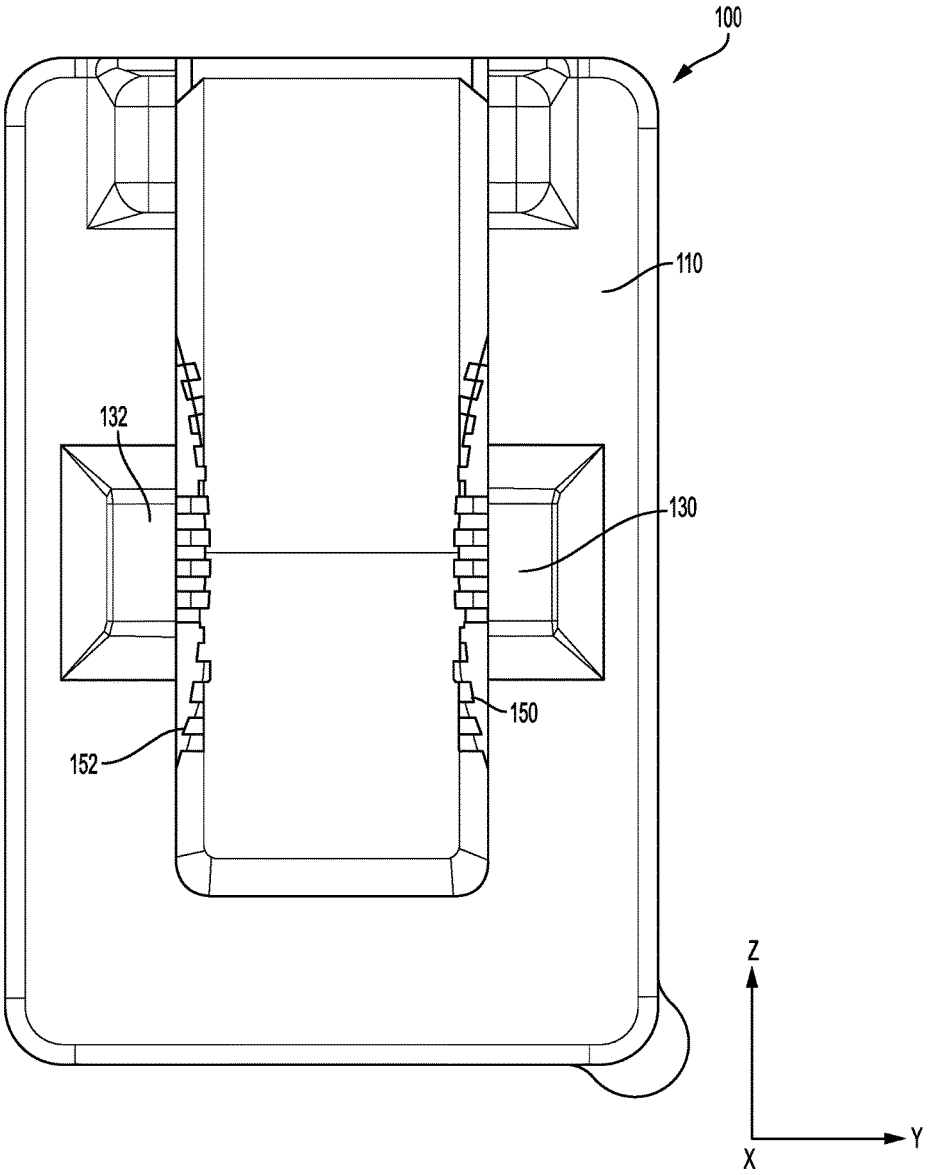
Figure 7:
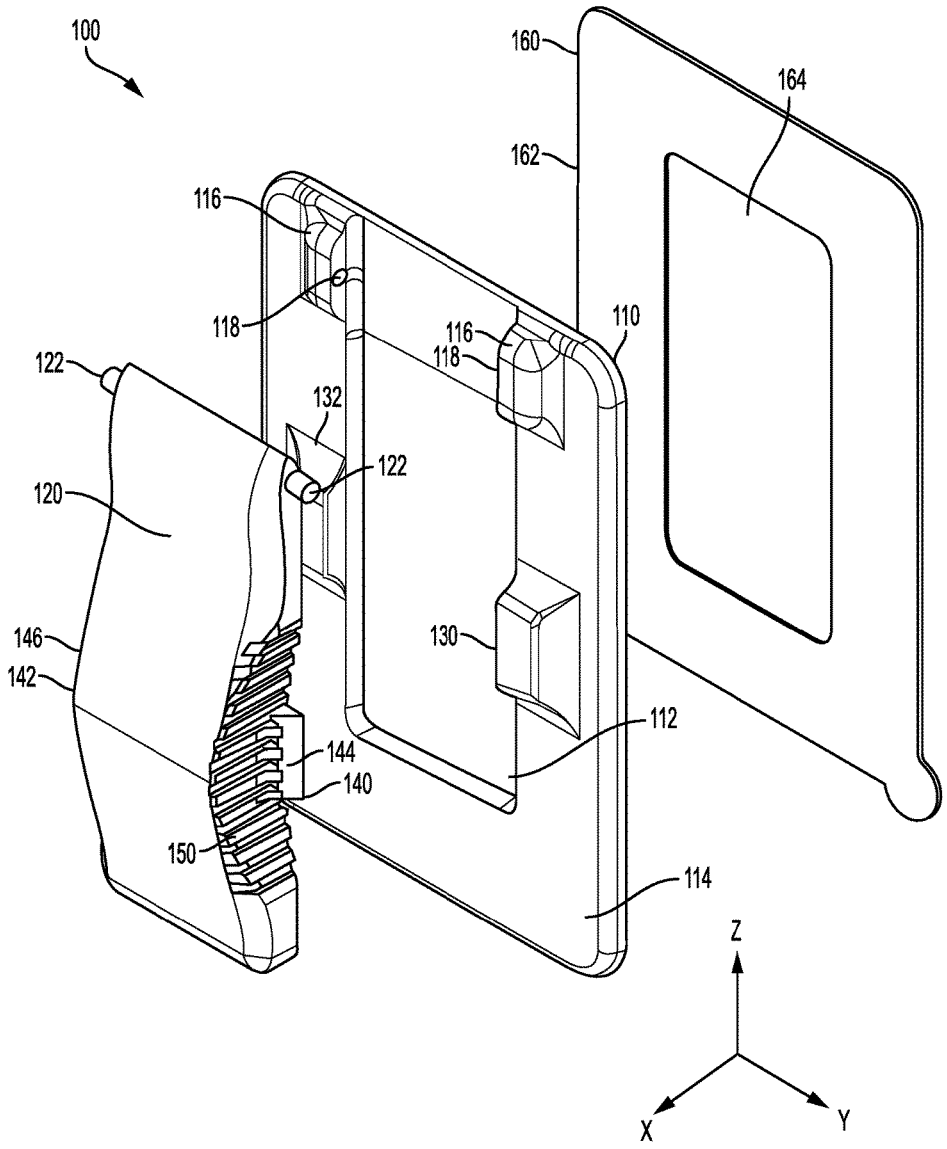
Figure 8:
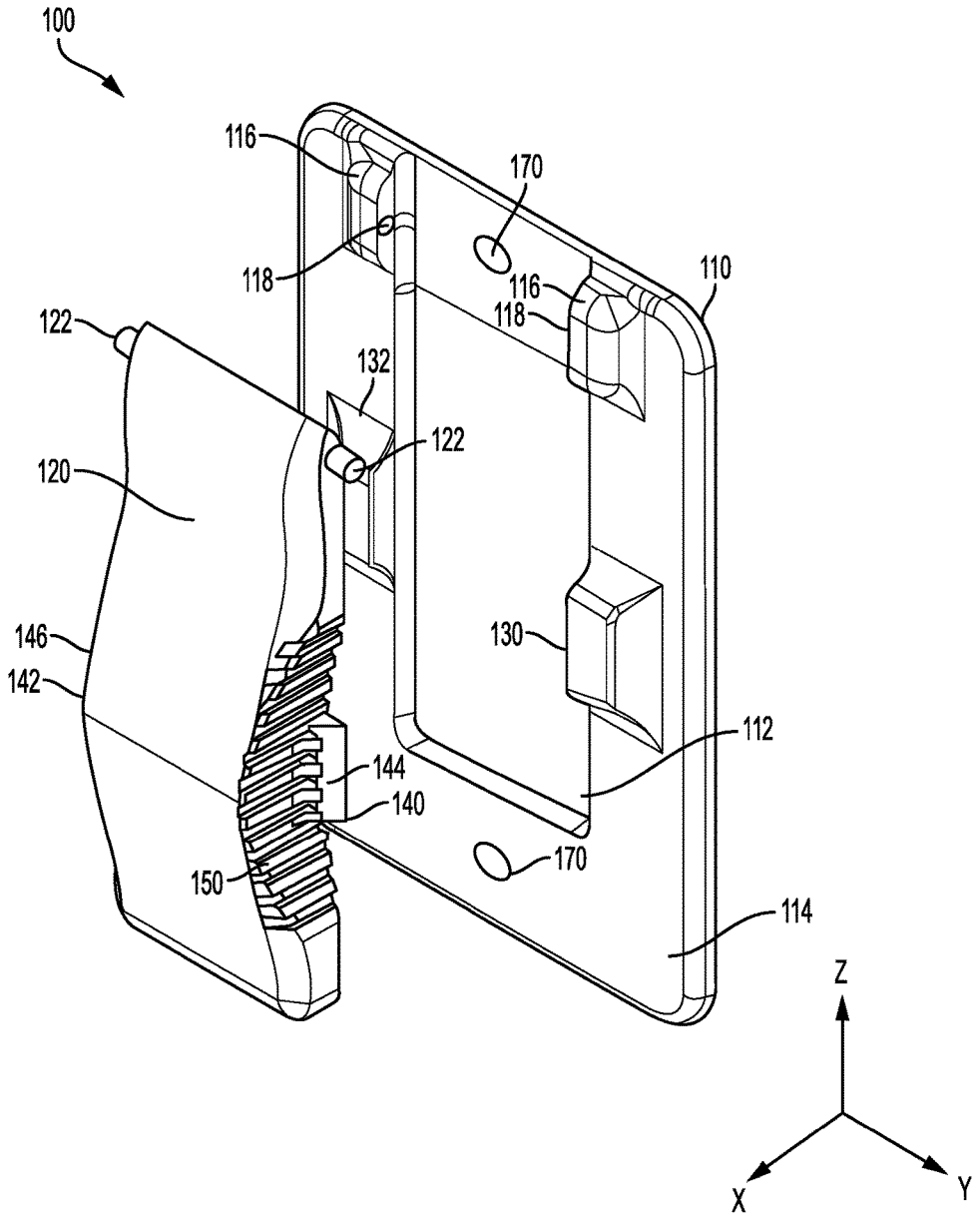
Figure 9:
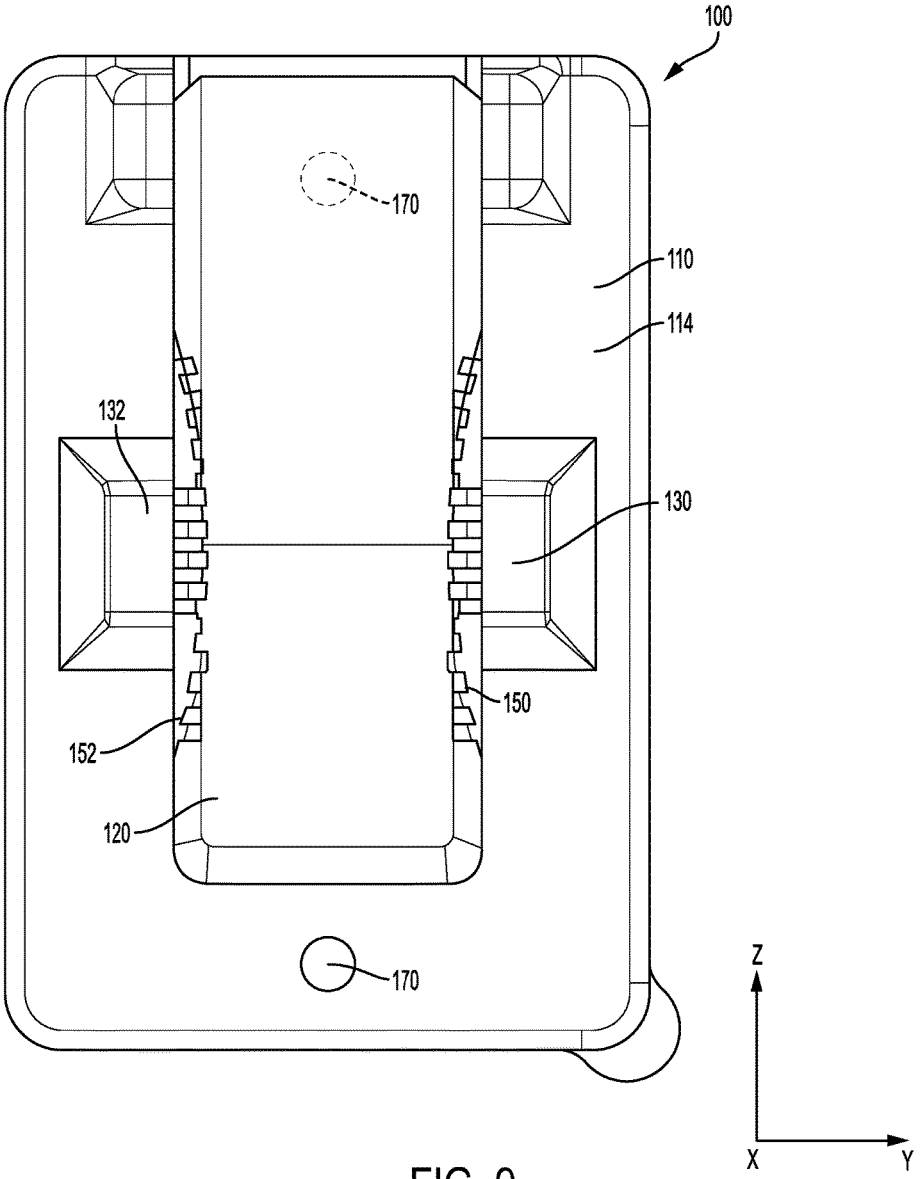
Figure 10:
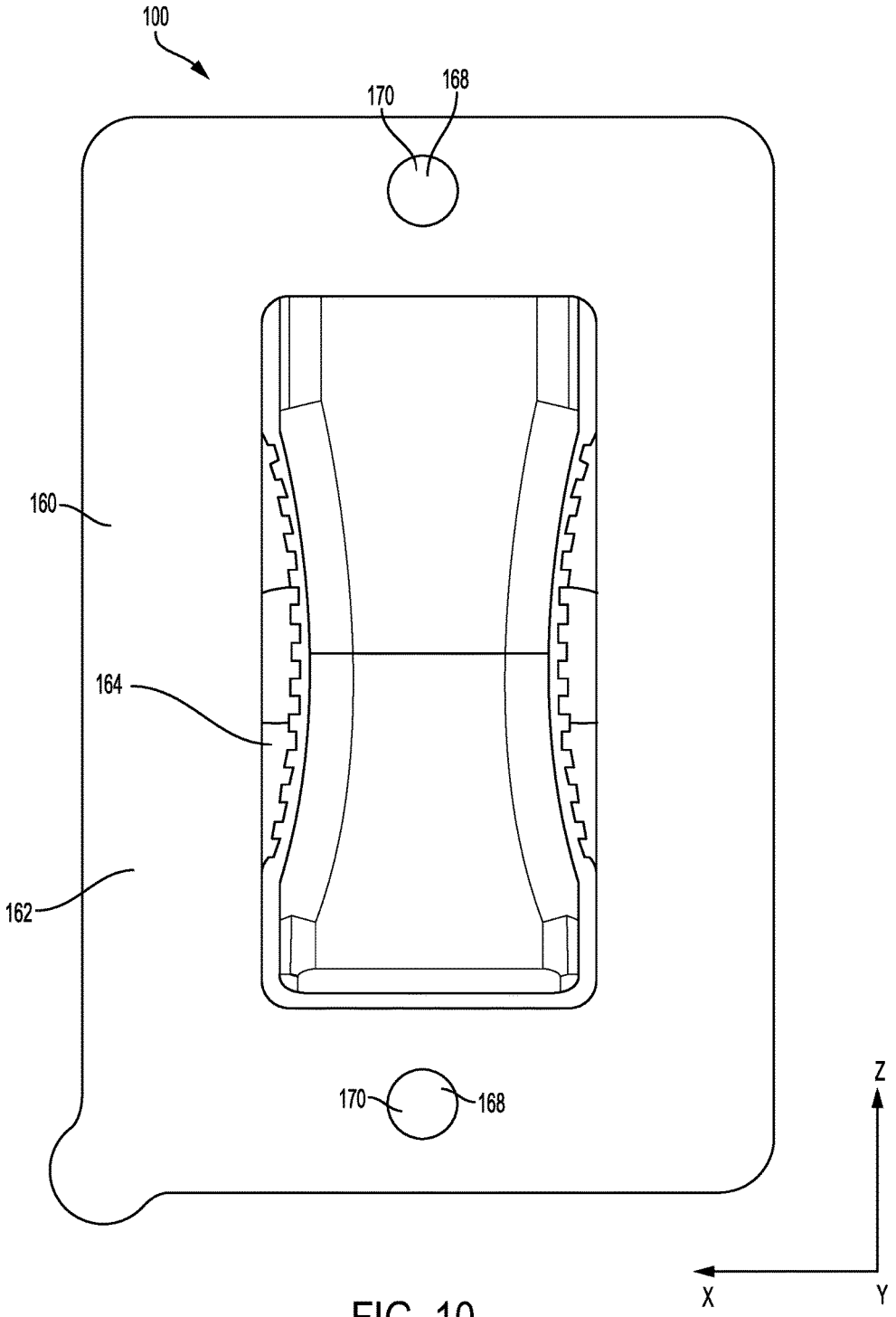
Figure 11A:
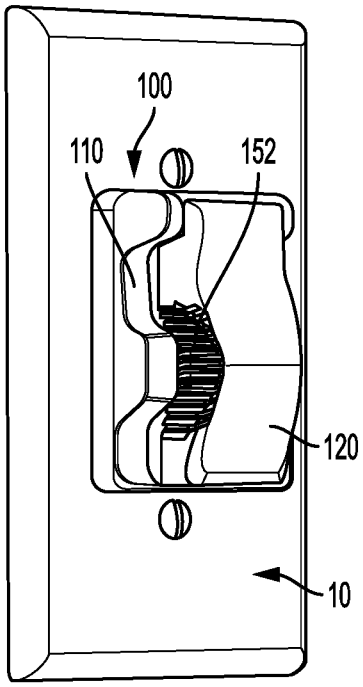
Figure 11B:
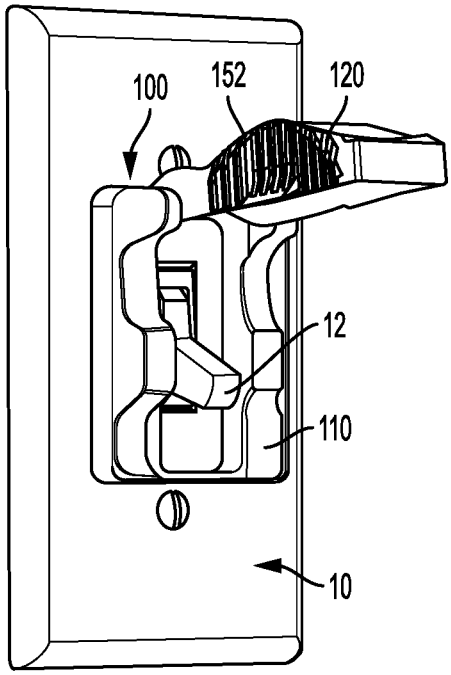

Having thus described the invention in general terms, reference will now be made to the accompanying drawings, which are not necessarily drawn to scale, and wherein:

FIG. 1 schematically depicts a perspective view of a light switch cover according to one or more embodiments shown and described herein;

FIG. 2 schematically depicts an exploded perspective view of the light switch cover of FIG. 1 according to one or more embodiments shown and described herein;

FIG. 3 schematically depicts a front view of the light switch cover of FIG. 1 according to one or more embodiments shown and described herein;

FIG. 4 schematically depicts a side view of the light switch cover of FIG. 1 according to one or more embodiments shown and described herein;

FIG. 5 schematically depicts an exploded perspective view of another light switch cover according to one or more embodiments shown and described herein;

FIG. 6 schematically depicts a front view of another light switch cover according to one or more embodiments shown and described herein;

FIG. 7 schematically depicts an exploded perspective view of the light switch cover of FIG. 6 according to one or more embodiments shown and described herein;

FIG. 8 schematically depicts an exploded perspective view of another light switch cover according to one or more embodiments shown and described herein;

FIG. 9 schematically depicts a front view of the light switch cover of FIG. 8 according to one or more embodiments shown and described herein;

FIG. 10 schematically depicts a rear view of the light switch cover of FIG. 8 according to one or more embodiments shown and described herein;

FIG. 11A schematically depicts a perspective view of the light switch cover of FIG. 1 in a closed position according to one or more embodiments shown and described herein; and FIG. 11B schematically depicts a perspective view of the light switch cover of FIG. 1 in an open position according to one or more embodiment shown and described herein.

DETAILED DESCRIPTION OF VARIOUS EMBODIMENTS

Various embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein;

rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. And terms are used both in the singular and plural forms interchangeably. Like numbers refer to like elements throughout.

Many modifications and other embodiments of the inventions set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein, the vertical direction (i.e., the +/−Z-direction as depicted) refers to the upward/downward direction of the light switch cover. The longitudinal direction (i.e., the +/−X-direction as depicted) refers to the forward/rearward direction of the light switch cover and is transverse to the vertical direction. The lateral direction (i.e., the +/−Y-direction as depicted) refers to the cross-wise direction of the light switch cover and is transverse to the vertical direction and the longitudinal direction.

Light switches are used in a variety of residential and commercial applications to selectively turn lights and other electrical devices on and off. The present application is directed to a light switch cover which selectively restricts access to a light switch. The light switch cover can be installed over a conventional light switch and may be coupled to the light switch by mechanical fasteners and/or an adhesive. In embodiments, the light switch cover includes a base portion and a cover that is pivotally coupled to the base portion. The cover includes a cover engagement member that is selectively engaged with a base engagement member to retain the cover in a closed position. To disengage the cover engagement member from the base engagement member, a user may depress a gripping surface. In embodiments, the gripping surface requires a predetermined amount of force to disengage the cover engagement member, which may prevent small children or individuals with special needs from accessing the light switch.

Referring initially to FIG. 1, a perspective view of a light switch cover 100 is depicted. The light switch cover 100 includes a base portion 110 and a cover 120 pivotally coupled to the base portion 110. The light switch cover 100 may be installed to a light switch to provide selective access to the light switch, as will be described in greater detail herein.

Referring to FIG. 2, an exploded perspective view of the light switch cover 100 is depicted. The base portion 110 includes an outer perimeter 114 that defines a central opening 112. The central opening 112 is sized to accommodate a light switch. The base portion 110 includes a hinge member 116 that extends outward from the outer perimeter 114 of the base portion 110. The hinge member 116 may be coupled to or may be integral with the base portion 110. In the embodiment depicted in FIG. 2, the hinge member 116 includes a pair of opposing apertures 118 that are shaped to accommodate a pair of pins 122 of the cover 120. In particular, when the cover 120 is installed to the base portion 112, the pins 122 of the cover 120 may be inserted into the apertures 118 of the hinge member 116 to pivotally couple the cover 120 to the base portion 110. While FIG. 2 depicts the cover 120 as being pivotally coupled to the base portion 110 through the pins 122 and the apertures 118, it should be understood that the hinge member 116 may include any suitable configuration to pivotally couple the cover 120 to the base portion 110, including but not limited to, a butt hinge, a strap hinge, a t-hinge, or the like.

Referring collectively to FIGS. 2 and 3, the exploded perspective view and a front view of the light switch cover 100 are depicted, respectively. The base portion 110 includes a first base engagement member 130 and a second base engagement member 132 that extend outward from the base portion 110. The first base engagement member 130 and the second base engagement member 132 are positioned around the central opening 112 and each assist in retaining the cover 120 in the closed position. In the embodiment depicted in FIG. 3, the first base engagement member 130 and the second base engagement member 132 are positioned on opposite sides of the central opening 112. The first base engagement member 130 and the second base engagement member 132 may be integral with or may be coupled to the base portion 110.

The cover 120 includes a first cover engagement member 140 that extends outward from the cover 120. In the embodiment shown in FIG. 2, the first cover engagement member 140 includes a tab 144 that extends outward from the cover 120. The tab 144 has a complementary shape that corresponds to and is the opposite of the shape of the first base engagement member 130. For example, in embodiments, the first base engagement member 130 may include a cavity that is shaped to accommodate the tab 144.

The cover 120 further includes a second cover engagement member 142 including a tab 146 that extends outward from the cover 120. While the second cover engagement member 142 is obscured in the perspective view depicted in FIG. 2, it should be understood that the cover 120 may be substantially symmetrical such that the second cover engagement member 142 is a mirror image of, and is substantially the same as the first cover engagement member 140. Similar to the first cover engagement member 142, the tab 146 of the second cover engagement member 142 has a complementary shape that corresponds to and is the opposite of the shape of the second base engagement member 132. For example, in embodiments, the second base engagement member 132 may include a cavity that is shaped to accommodate the tab 146.

The cover 120 includes a first gripping surface 150 and a second gripping surface 152 that is positioned opposite of the first gripping surface 150. In the embodiment depicted in FIG. 3, the first gripping surface 150 and the second gripping surface 152 are oriented to face outward from the cover 120 in the lateral direction. When the cover 120 is in the closed position, as shown in FIG. 3, the first gripping surface 150 and the second gripping surface 152 are oriented to face in a direction that is transverse to the base portion 110. The first gripping surface 150 and the second gripping surface 152 each include a textured grating, depicted in FIG. 3 as being a plurality of ribs on the cover 120. The textured grating of the first gripping surface 150 and the second gripping surface 152 may assist a user in grasping the cover 120 to manipulate a position of the first cover engagement member 140 and the second cover engagement member 142, as will be described in greater detail herein.

The first gripping surface 150 is operatively connected to the first cover engagement member 140. In particular, the first cover engagement member 140 extends outward from the cover 120 at the first gripping surface 150. The first cover engagement member 140 is movable between an extended position, as shown in FIG. 2, to a retracted position, in which the first cover engagement member 140 moves inward into the cover 120 (i.e., in the −Y-direction as depicted in FIG. 2). To move the first cover engagement member 140 into the retracted position, a user may depress the first gripping surface 150. When the user ceases depressing the first gripping surface 150, the first cover engagement member 140 may return to the extended position shown in FIG. 2.

Similarly, the second gripping surface 152 is operatively connected to the second cover engagement member 142, and the second cover engagement member 142 extends outward from the cover 120 at the second gripping surface 152. The second cover engagement member 142 is similarly movable from an extended position to a retracted position, in which the second cover engagement member 142 moves inward into the cover 120 (i.e., in the +Y-direction as depicted in FIG. 2). To move the second cover engagement member 142 into the retracted position, a user may depress the second gripping surface 152. When the user ceases depressing the second gripping surface 152, the second cover engagement member 142 may return to the extended position. In this way, the first gripping surface 150 and the second gripping surface 152, and accordingly, the first cover engagement member 140 and the second cover engagement member 142 are movable between the extended position and the retracted position. In embodiments, the first gripping surface 150 and the second gripping surface 152 are integral with the cover 120 and may be elastically deformed as the user depresses the first gripping surface 150 and the second gripping surface 152. Through the elastic deformation of the first gripping surface 150 and the second gripping surface 152, the first cover engagement member 130 and the second cover engagement member 132 are moved between the extended position and the retracted position. In such embodiments, the cover 120, and accordingly the first gripping surface 150 and the second gripping surface 152 may be formed from any suitable material that will elastically deform under depression by a user, including but not limited to, a polymer, a metal, a composite, or the like.

In alternative embodiments, the first gripping surface 150 and the second gripping surface 152 may be separate from and slidably coupled to the cover 120 and may move with respect to cover 120. In such embodiments, a biasing member may be coupled to the first gripping surface 150 and the second gripping surface 152, and may bias the first gripping surface 150 and the second gripping surface 152 into the extended position when not depressed by a user. Regardless of whether the first gripping surface 150 and the second gripping surface 152 are integral with or are slidably coupled to the cover 120, the first gripping surface 150 and the second gripping surface 152 may require a predetermined amount of force to move from the extended position to the retracted position. For example, the predetermined amount of force may be a force chosen such that a typical adult may manipulate the first gripping surface 150 and the second gripping surface 152 from the extended to the retracted position, while a small child or special needs individual may be unable to move the first gripping surface 150 and the second gripping surface 152 from the extended position to the retracted position.

Referring collectively to FIGS. 3 and 4, the front view and a side view of the light switch cover 100 are schematically depicted. The base portion 110 includes tabs 172 that extend outward from the base portion 110. Each of the tabs 172 define a pair of installation holes 170 that are spaced apart from one another in the vertical direction so as to correspond to the positioning of installation screws of a light switch plate. For example, in some configurations, the pair of installation holes 170 are spaced apart by a distance of 2⅜ inches, which corresponds to the conventional spacing of installation screws on a light switch. In the embodiment shown in FIG. 3, the pair of installation holes 170 are positioned within or at least partially within the tabs 172 that extend outward from the outer perimeter 114 of the base portion 110. By including the pair of installation holes 170 on (or at least partially within) the tabs 172 that extend outward from the outer perimeter 114 of the base portion 110, the installation holes 170 may be positioned outside of the cover 120. As such, the light switch cover 100 may be installed to a light switch regardless of whether the cover 120 (FIG. 1) is in the open position or the closed position, which may reduce the difficulty of installing the light switch cover 100 to the light switch.

Referring to FIGS. 5 and 6, an exploded view of another light switch cover 100 is schematically depicted. In embodiments, the light switch cover 100 may optionally include an adhesive layer 160 that is positioned on and coupled to the base portion 110. In embodiments, the adhesive layer 160 may include a double sided adhesive that may couple the light switch cover 100 to a light switch. The adhesive layer 160 includes an outer perimeter 162 and a central opening 164 that correspond with and are aligned with the outer perimeter 114 and the central opening 112 of the base portion 110.

In the embodiment depicted in FIG. 5, the base portion 110 includes the pair of installation holes 170 that are spaced apart from one another in the vertical direction. Accordingly, in the embodiment depicted in FIG. 5, the light switch cover 100 may be coupled to a light switch by both mechanical fasteners positioned in the installation holes 170, as well as through the adhesive layer 160.

Referring collectively to FIGS. 6 and 7, in some embodiments, the light switch cover 100 may be coupled to a light switch through the adhesive layer 160 alone. In particular and as shown in FIGS. 6 and 7, the base portion 110 may lack the installation holes 170 (FIG. 5), and the base portion 110 may be coupled to a light switch solely through the adhesive layer 160. In such embodiments, the complexity and amount of time spent installing the light switch cover 100 to a light switch may be minimized.

Referring collectively to FIGS. 8, 9, and 10 collectively, in some embodiments, the base portion 170 may include the pair of installation holes 170 that are spaced apart from one another in the vertical direction, and the installation holes 170 may be positioned within the outer perimeter 114 of the base portion 110. As shown in FIG. 10, in embodiments that include the optional adhesive layer 160, the adhesive layer 160 may additionally or alternatively have a pair of installation holes 168 extending through the adhesive layer 160 and that correspond to and are aligned with the installation holes 170 of the base portion 110. As with the embodiments described above, the pair of installation holes 170 are spaced apart from one another in the vertical direction so as to correspond to the positioning of installation screws of a light switch plate. For example, in some configurations, the pair of installation holes 170 are spaced apart by a distance of 2⅜ inches, which corresponds to the conventional spacing of installation screws on a light switch. In the embodiment shown in FIGS. 8 and 9, one or both of the installation holes 170 may be covered and obscured by the cover 120 when the cover 120 is in the closed position. Alternatively, both of the installation holes 170 may be positioned outside of the cover 120 such that the installation holes 170 are accessible when the cover 120 is in the closed position.

Referring now to FIGS. 11A and 11B, the light switch cover 100 is depicted in a closed position and an open position, respectively. As shown in FIGS. 11A and 11B, the light switch cover 100 is coupled to a light switch 10 including a toggle switch 12. When the light switch cover 100 is installed to the light switch 10, the toggle switch 12 may be positioned such that the toggle switch 12 extends through the central opening 112 of the base portion 110 (FIG. 2) and through the central opening 164 of the adhesive layer 160 (FIG. 5) in embodiments that include the adhesive layer 160. As shown in FIG. 11A, the cover 120 is in the closed position and the first cover engagement member 140 (FIG. 2) is engaged with the first base engagement member 130 (FIG. 2) and the second cover engagement member 142 is engaged with the second base engagement member 132. Through the engagement between the first cover engagement member 140 with the first base engagement member 130 and the second cover engagement member 142 with the second base engagement member 132, the cover 120 is retained in the closed position depicted in FIG. 11A. In the closed position, the cover 120 covers the toggle switch 12 (FIG. 11B), preventing access to the toggle switch 12. By preventing access to the toggle switch 12, the light switch cover 120 may selectively prevent a person, such as a child or a special needs individual from manipulating the toggle switch 12. As described above, the first gripping surface 150 and the second gripping surface 152 may require a predetermined amount of force to be move the first cover engagement member 140 and the second cover engagement member 142 from the extended position into the retracted position, and the predetermined amount of force may be chosen such that a small child may be unable to move the first gripping surface 150 and the second gripping surface 142 into the retracted position. In this way, the light switch cover may prevent small children or special needs individuals from accessing and manipulating the toggle switch 12, and accordingly from turning lights or other electrical devices controlled by the toggle switch 12 on and off.

To move the cover 120 between the closed position, shown in FIG. 11A, to the open position, shown in 11B, a user may grasp the first gripping surface 150 (FIG. 3) and the second gripping surface 152 (FIG. 3). As described above, by depressing the first gripping surface 150 and the second gripping surface 152 into the cover 120 in the lateral direction, the first cover engagement member 140 and the second cover engagement member 142 may be moved inward into the cover 120 in the lateral direction. By moving the first cover engagement member 140 and the second cover engagement member 142 inward in the lateral direction, the first cover engagement member 140 is disengaged from the first base engagement member 130 and the second cover engagement member 142 is disengaged from the second base engagement member 132. Once the first cover engagement member 140 and the second cover engagement member 142 are disengaged, a user may rotate the cover 120 about the hinge member 116. As the cover 120 rotates about the hinge member 116, the toggle switch 12 is exposed, allowing a user to move the toggle switch 12 between an on and an off position. Once the toggle switch 12 is in a desired position (i.e., in the on or off position as the user desires), the user may move the cover 120 back into the closed position shown in FIG. 11A to restrict access to the toggle switch 12. In embodiments, the cover 120 is shaped such that the cover 120 may be returned to the closed position whether the toggle switch 12 is in the on position or the off position.

Accordingly, it should now be understood that light switch covers according to the present disclosure selectively restrict access to a light switch. The light switch cover can be installed over a conventional light switch and may be coupled to the light switch by an adhesive or mechanical fastener. In some embodiments, the light switch cover may include installation holes that correspond to the conventional spacing of light switch installation screws. By coupling the light switch cover to the light switch using mechanical fasteners and/or an adhesive that that can be installed in the same pattern as conventional light switch installation screws, light switch covers according to the present disclosure can be readily installed to existing light switches.

In embodiments, the light switch cover includes a base portion and a cover that is pivotally coupled to the base portion. The cover includes a cover engagement member that is selectively engaged with a base engagement member to retain the cover in a closed position. To disengage the cover engagement member from the base engagement member, a user may depress a gripping surface. In embodiments, the gripping surface requires a predetermined amount of force to disengage the cover engagement member, which may prevent small children or individuals with special needs from accessing the light switch.

CONCLUSION

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A light switch cover comprising:

a base portion defining a central opening, the base portion comprising an outer perimeter that extends around the central opening;

a first base engagement member extending outward from the base portion and positioned on a first side of the central opening;

a second base engagement member extending outward from the base portion and positioned on a second side of the central opening that is different from the first side of the central opening;

a cover pivotally coupled to the base portion along a first side of the cover, wherein the cover is repositionable, via pivoting along the first side, between a closed position, in which the cover is positioned over the central opening, and an open position, in which the central opening is exposed;

a first cover engagement member positioned on a second side of the cover, wherein the second side is perpendicular to the first side, wherein the first cover engagement member is spaced a distance from the first side, wherein the first cover engagement member has a complementary shape to the first base engagement member, and wherein the first cover engagement member is selectively engaged with the first base engagement member when the cover is in the closed position; and a second cover engagement member positioned on a third side of the cover, wherein the third side is opposite and parallel the second side, wherein the second cover engagement member is spaced a distance from the first side, wherein the second cover engagement member has a complementary shape to the second base engagement member, and wherein the second cover engagement member is selectively engaged with the second base engagement member when the cover is in the closed position.

2. The light switch cover of claim 1, wherein the cover defines a gripping surface that is oriented transverse to the base portion when the cover is in the closed position.

3. The light switch cover of claim 2, wherein the gripping surface is elastically deformable between an extended position and a retracted position.

4. The light switch cover of claim 2, wherein the gripping surface comprises a textured grating.

5. The light switch cover of claim 1, wherein the base portion defines a pair of installation holes that are spaced apart from one another to correspond to the position of light switch installation screws.

6. The light switch cover of claim 1, wherein the first cover engagement member comprises a tab extending outward from the cover.

7. The light switch cover of claim 1, further comprising a hinge member positioned on the base portion, wherein the first side of the cover is pivotally coupled to the base portion at the hinge member.

8. The light switch cover of claim 7, wherein the hinge member is positioned on the outer perimeter of the base portion.

9. The light switch cover of claim 1, further comprising an adhesive layer coupled to the base portion, the adhesive layer comprising a central opening that is aligned with the central opening of the base portion.

10. A light switch cover comprising:

a base portion defining a central opening, the base portion comprising an outer perimeter that extends around the central opening;

a base engagement member positioned on the base portion;

a cover pivotally coupled to the base portion along a first side of the cover, wherein the cover is repositionable, via pivoting along the first side, between a closed position, in which the cover is positioned over the central opening, and an open position, in which the central opening is exposed;

a cover engagement member positioned on a second side of the cover, wherein the second side is perpendicular to the first side, wherein the cover engagement member is spaced a distance from the first side, wherein the cover engagement member has a complementary shape to the base engagement member, and wherein the cover engagement member is selectively engaged with the base engagement member when the cover is in the closed position; and wherein the cover defines a gripping surface that is operatively connected to the cover engagement member, wherein the gripping surface is repositionable between an extended position, in which the cover engagement member is in an extended position, and a retracted position, in which the cover engagement member is in a retracted position.

11. The light switch cover of claim 10, wherein the gripping surface is oriented transverse to the base portion when the cover is in the closed position.

12. The light switch cover of claim 10, wherein the gripping surface is elastically deformable between the extended position and the retracted position.

13. The light switch cover of claim 10, wherein the gripping surface comprises a textured grating.

14. The light switch cover of claim 10, wherein the base portion defines a pair of installation holes that are spaced apart from one another to correspond to the position of light switch installation screws.

15. The light switch cover of claim 10, wherein the base engagement member defines a cavity.

16. The light switch cover of claim 10, further comprising a hinge member positioned on the base portion, wherein the first side of the cover is pivotally coupled to the base portion at the hinge member.

17. The light switch cover of claim 16, wherein the hinge member is positioned on the outer perimeter of the base portion.

18. The light switch cover of claim 10, further comprising an adhesive layer coupled to the base portion, the adhesive layer comprising a central opening that is aligned with the central opening of the base portion.

19. The light switch cover of claim 10, wherein the gripping surface is a first gripping surface that is oriented to face outward in a lateral direction, and cover further comprises a second gripping surface that is oriented to face outward in a lateral direction opposite of the first gripping surface, wherein the second gripping surface is operatively connected to a second cover engagement member.

20. The light switch cover of claim 19, wherein the second gripping surface is elastically deformable between an engaged position and a retracted position.

* * * * *